US005406244A

United States Patent [19]

Thwaites et al.

[11] Patent Number: 5,406,244

[45] Date of Patent: Apr. 11, 1995

[54] TIME DELAY FUSE

[75] Inventors: Clifford J. Thwaites; Ladislav L. Baraz, both of Mississauga; Mikhail Manoim, Thornhill, all of Canada

[73] Assignee: Gould Electronics Inc., Eastlake, Ohio

[21] Appl. No.: 196,843

[22] Filed: Jan. 25, 1994

[51] Int. Cl.[6] ..... H01H 85/04

[52] U.S. Cl. ..... 337/163; 337/165

[58] Field of Search ..... 337/161, 162, 163, 164, 337/165, 166

[56] References Cited

U.S. PATENT DOCUMENTS

| | | | |
|---|---|---|---|
| 2,064,034 | 12/1936 | Rudnick . | |
| 2,181,825 | 11/1939 | Wood . | |
| 2,694,124 | 11/1954 | Laing et al. | 337/163 |
| 2,876,312 | 3/1959 | Frederick . | |
| 3,089,012 | 5/1963 | Abrams | 337/165 |
| 3,593,249 | 7/1971 | Sedgwick . | |
| 3,636,491 | 1/1972 | Cameron . | |
| 3,678,430 | 7/1972 | Gaia | 337/164 |
| 3,723,931 | 3/1973 | Urani . | |
| 4,166,267 | 8/1979 | Belcher et al. . | |
| 4,414,526 | 11/1983 | Panaro . | |
| 4,562,420 | 12/1985 | Kowalik et al. . | |
| 4,593,262 | 6/1986 | Krueger . | |
| 4,994,779 | 2/1991 | Douglass . | |
| 5,043,689 | 8/1991 | DiTroia et al. . | |
| 5,075,664 | 12/1991 | Spalding et al. . | |
| 5,235,306 | 8/1993 | Kalra et al. . | |
| 5,247,274 | 9/1993 | Gurevich . | |

*Primary Examiner*—Lincoln Donovan
*Attorney, Agent, or Firm*—Fish & Richardson

[57] ABSTRACT

A time delay fuse that includes a trigger mechanism and fusible element within a cylindrical fuse casing that is closed by end ferrules. The trigger mechanism includes a plunger, a spring, and a cylindrical shell that contains the spring and plunger in a loaded condition. The shell has an end that wraps around an end of the fuse casing and is frictionally contacted by the end ferrule thereover.

10 Claims, 1 Drawing Sheet

TIME DELAY FUSE

BACKGROUND OF THE INVENTION

The invention relates to time delay fuses.

Time delay fuses often employ trigger mechanisms in which a spring-loaded plunger is retained by solder that slowly heats up at low overload conditions. If the low overload condition is sustained for a sufficiently long period of time, the solder melts, releasing the plunger and breaking the circuit. In one type of configuration employing a trigger mechanism, the plunger and spring are located in a metal shell that is soldered to an end cap terminal. In this type of configuration, during manufacture, when melting the solder that connects the shell to the end cap, care must be taken to avoid melting the solder that retains the plunger.

SUMMARY OF THE INVENTION

In general the invention features a time delay fuse that includes a trigger mechanism and fusible element within a cylindrical fuse casing that is closed by end ferrules. The trigger mechanism includes a plunger, a spring, and a cylindrical shell that contains the spring and plunger in a loaded condition. The shell has an end that wraps around an end of the fuse casing and is frictionally contacted by the end ferrule thereover. Manufacture is simplified by the use of the wrap-around end of the shell, which holds the shell in place after it is inserted into the fuse casing. In addition, the shell automatically makes electrical contact with the end ferrule when the end ferrule is attached to the fuse casing. This eliminates the steps relating to inserting solder between the shell and the ferrule and then soldering the two together after crimping of the end ferrule. It also eliminates restrictions on choosing the melt point of the solder used to connect and retain the plunger.

In preferred embodiments, the end of the shell is cylindrical and continuous all of the way around the end of the fuse casing. The fuse casing has a recessed area on its outer surface for receiving the end of the shell. The shell has portions with two diameters inside the fuse casing, a smaller diameter portion that receives only the plunger therein, and a larger diameter portion that receives the plunger and the spring therein. The plunger includes a shaft that extends through the shell's smaller diameter portion and a head that engages the spring. The end ferrule defines a cavity outside of the fuse casing for receiving the head after the solder has melted, and the spring has displaced the plunger. A second solder mass mechanically and electrically connects the smaller diameter portion of the shell to the plunger and prevents arc-quenching fill from entering the shell and interfering with the action of the trigger mechanism.

Other advantages and features of the invention will be apparent from the following description of the preferred embodiment thereof and from the claims.

DESCRIPTION OF THE PREFERRED EMBODIMENT

Figure 1:
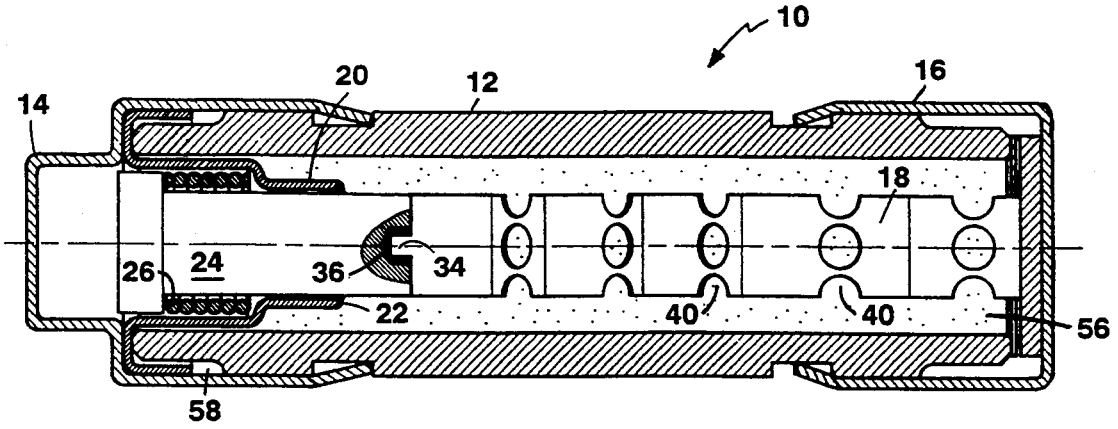
FIG. 1 is a sectional view of a time delay fuse according to the invention, the section being taken along the longitudinal axis of the fuse casing.
Figure 2:
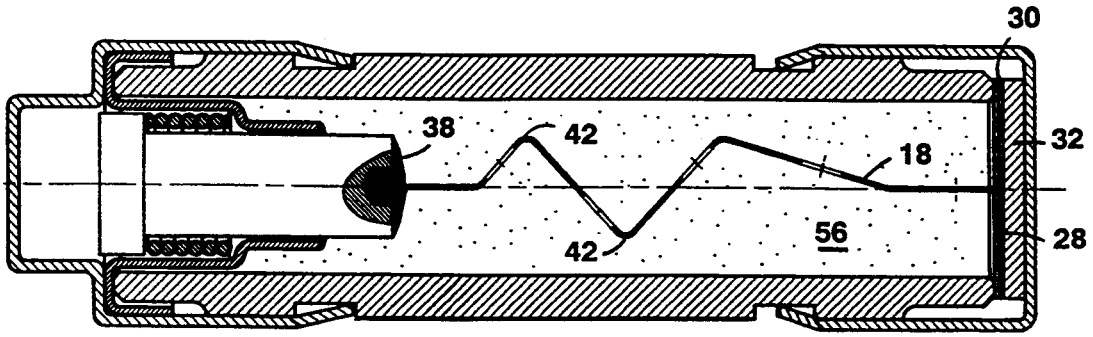
FIG. 2 is a sectional view of the FIG. 1 fuse taken at a section that is rotated from the FIG. 1 section by 90 degrees.
Figure 3:
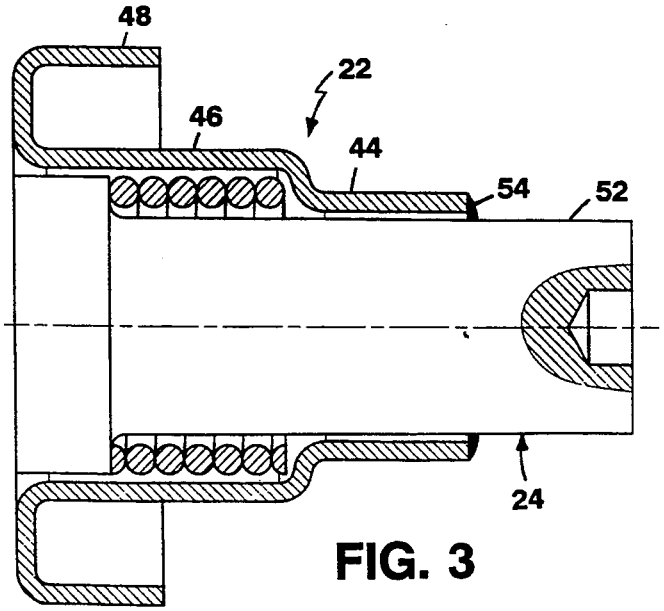
FIG. 3 is an enlarged sectional view of a trigger mechanism of the FIG. 1 fuse.

Referring to the FIGS. 1-3, fuse 10 includes fuse casing 12, end ferrules 14 and 16 at the ends of casing 12, and fusible element 18 and trigger mechanism 20 inside casing 12. Trigger mechanism 20 includes shell 22, plunger 24 and spring 26. Fusible element 18 has bent end 28 that passes through a slot in split washer 30, is compressed between split washer 30 and solid washer 32, and is held therein by solder (not shown on FIGS. 1 and 2). At the other end of fusible element 18 is tab 34, which is received in depression 36 of plunger 24 and is physically held therein and electrically connected thereto by solder mass 38. Fusible element 18 has a plurality of notch sections 40 along its length and has bends 42 to increase the length of element 18 that can fit within a length of fuse casing 12.

Shell 22 is generally cylindrical and has small diameter portion 44, larger diameter portion 46, and end 48 that wraps around the end of fuse casing 12 and is contacted by end ferrule 14 thereover. There is a frictional fit between the outer surface of end 48, which has an outer diameter of 0.376″+0.000″−0.001″ and the inner surface of the mating portion of end ferrule 14, which has an inner diameter of 0.375″+0.001″−0.001″. There is a loose fit between the inner surface of end 48, which has an inner diameter of 0.351″+0.000″−0.005″, and the outer surface of fuse casing 12, which has an outer diameter of 0.335+0.003″−0.003″.

Referring to FIG. 3, there is a loose fit between the inner surface of larger diameter portion 46 and the outer surface of head 50 of plunger 24 therein. There also is a loose fit between the inner surface of smaller diameter portion 44 and the outer surface of shaft 52 of plunger 24 therein. These loose fits permit free sliding of plunger 24 within shell 22. Solder mass 54 closes the opening to smaller diameter portion 44 around shaft 52, making mechanical and electrical connection and also providing a barrier preventing the introduction of arc quenching fill 56 (40/60 quartz) into trigger mechanism 20.

Both solder mass 38 and solder mass 54 are 95° C. eutectic solder.

In manufacture, a subassembly including trigger mechanism 20 and fusible element 18 is first made by inserting shaft 52 and spring 26 thereover into shell 22, adding solder mass 54 while spring 26 is compressed, and soldering tab 34 of fusible element 18 inside depression 36 using solder mass 38. The subassembly is then inserted into fuse casing 12. End 48 passes over the end of casing 12 and is received in annular recess 58. End 48 holds shell 22 and the rest of the subassembly in position. End ferrule 14 is then placed over end 48, making frictional contact therewith, and is then crimped onto casing 12. In so doing, shell 22 is automatically electrically connected to end ferrule 14 when end ferrule 14 is attached to fuse casing 12, without any need to insert solder between the shell and the ferrule and then melt the solder between the two after crimping. The manufacture at this end of fuse 10 is thus simplified by the use of wrap-around end 48 of shell 22 and its frictional contact with end ferrule 14. Eliminating the soldering step removes restrictions on choosing the melt point of solder masses 38 and 54.

Arc quenching fill 56 is then filled into the region around fusible element 18 from the other end of fuse casing 12. The end of fusible element is fed through the slit of washer 30, is bent, and is sandwiched between washer 30 and washer 32 with solder. End ferrule 16 is then crimped onto fuse casing 12, and the solder is melted.

In use, fusible element 18 quickly blows at high overload (e.g., short circuit) conditions, breaking the circuit. At low overload conditions, plunger 24 and shell 22 gradually increase in temperature. With sustained low overload conditions, solder masses 38 and 54 melt, releasing plunger 24, which moves away from fusible element 18, breaking the circuit.

Other embodiments of the invention are within the scope of the following claims.

What is claimed is:

1. A time delay fuse comprising a cylindrical fuse casing having two ends, said fuse casing having an inner surface portion with an inner diameter and an outer surface portion with an outer diameter portion adjacent one said end, first and second end ferrules closing said two ends of said fuse casing, a fusible element and a spring-biased trigger mechanism located within said fuse casing and electrically connected in series between said two end ferrules, said trigger mechanism including a plunger that is mechanically and electrically connected to said fusible element by a first solder mass and has a spring engaging portion, a spring that engages said spring engaging portion of said plunger and biases said plunger away from said fusible element, a cylindrical shell that sits within said fuse casing, surrounds said plunger and said spring, and has an end that wraps around said one end of said fuse casing, said end of said cylindrical shell including an inner axially-aligned portion that extends along said inner surface portion to said end, a radially disposed end portion that extends from said inner, axially-aligned portion at a diameter less than said inner diameter to a diameter greater than said outer diameter, and an outer, axially-aligned portion that extends from said radially disposed end portion along said outer surface portion and is frictionally contacted by said first end ferrule thereover.

2. The fuse of claim 1 wherein said end of said shell is cylindrical and is continuous all of the way around said end of said fuse casing.

3. The fuse of claim 1 wherein said fuse casing has a recessed area on its outer surface for receiving said outer, axially aligned of said shell.

4. The fuse of claim 1 wherein said shell has portions with two diameters inside said fuse casing, a smaller diameter portion that receives only said plunger therein, and a larger diameter portion that receives said plunger and said spring therein.

5. The fuse of claim 4 wherein said plunger has a shaft portion that extends through said smaller diameter portion and a head that provides said spring engaging portion, said spring surrounding said shaft in said larger diameter portion.

6. The fuse of claim 5 wherein said first end ferrule defines a cavity outside of said fuse casing for receiving said head after said solder has melted, and said spring has displaced said plunger.

7. The fuse of claim 4 wherein a second solder mass mechanically and electrically connects said smaller diameter portion of said shell to said plunger.

8. The fuse of claim 1 wherein said fusible element has bends and reduced area sections.

9. The fuse of claim 7 further comprising arcquenching fill inside said fuse casing around said fusible element, and wherein said second solder mass extends around said plunger between said plunger and shell, preventing arcquenching fill from entering said shell.

10. The fuse of claim 1 wherein said fusible element has a tab, and said plunger has a recess that receives said tab and said first solder mass.

* * * * *